US006629647B2

(12) United States Patent
Boecking

(10) Patent No.: US 6,629,647 B2
(45) Date of Patent: Oct. 7, 2003

(54) PRESSURE-CONTROLLED INJECTOR WITH CONTROLLED NOZZLE NEEDLE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 72 days.

(21) Appl. No.: 09/893,436

(22) Filed: Jun. 29, 2001

(65) Prior Publication Data

US 2002/0020765 A1 Feb. 21, 2002

(30) Foreign Application Priority Data

Jun. 29, 2000 (DE) ..... 100 31 582

(51) Int. Cl.[7] ..... F02M 47/02; F02M 59/00; F02M 61/02; F02M 51/00; B05B 1/30

(52) U.S. Cl. ..... 239/88; 239/533.2; 239/533.3; 239/533.9; 239/585.1; 239/585.3; 239/585.4; 239/585.5

(58) Field of Search ..... 239/88, 89, 90, 239/91, 93, 96, 5, 533.2, 533.3, 533.9, 585.5, 585.1, 585.3, 585.4; 123/467, 506, 446; 251/127, 129.15, 129.21

(56) References Cited

U.S. PATENT DOCUMENTS 6,085,719 A * 7/2000 Heinz et al. ..... 123/300
6,244,250 B1 * 6/2001 Hlousek ..... 123/467
6,328,017 B1 * 12/2001 Heinz et al. ..... 123/467
6,422,209 B1 * 7/2002 Mattes ..... 123/467

* cited by examiner

*Primary Examiner*—Davis D Hwu
(74) *Attorney, Agent, or Firm*—Ronald E. Greigg

(57) ABSTRACT

The invention relates to an injector for injecting fuel, which is at high pressure, into the combustion chambers of an internal combustion engine. In the injector housing of the injector, a control part and a nozzle needle are received movably, and the injection nozzle inlet is opened by opening a valve chamber and by pressure relief of a control chamber. In the injector housing, control chambers for actuating a nozzle needle and the control part are provided, which can be pressure-relieved via a common control valve.

8 Claims, 1 Drawing Sheet

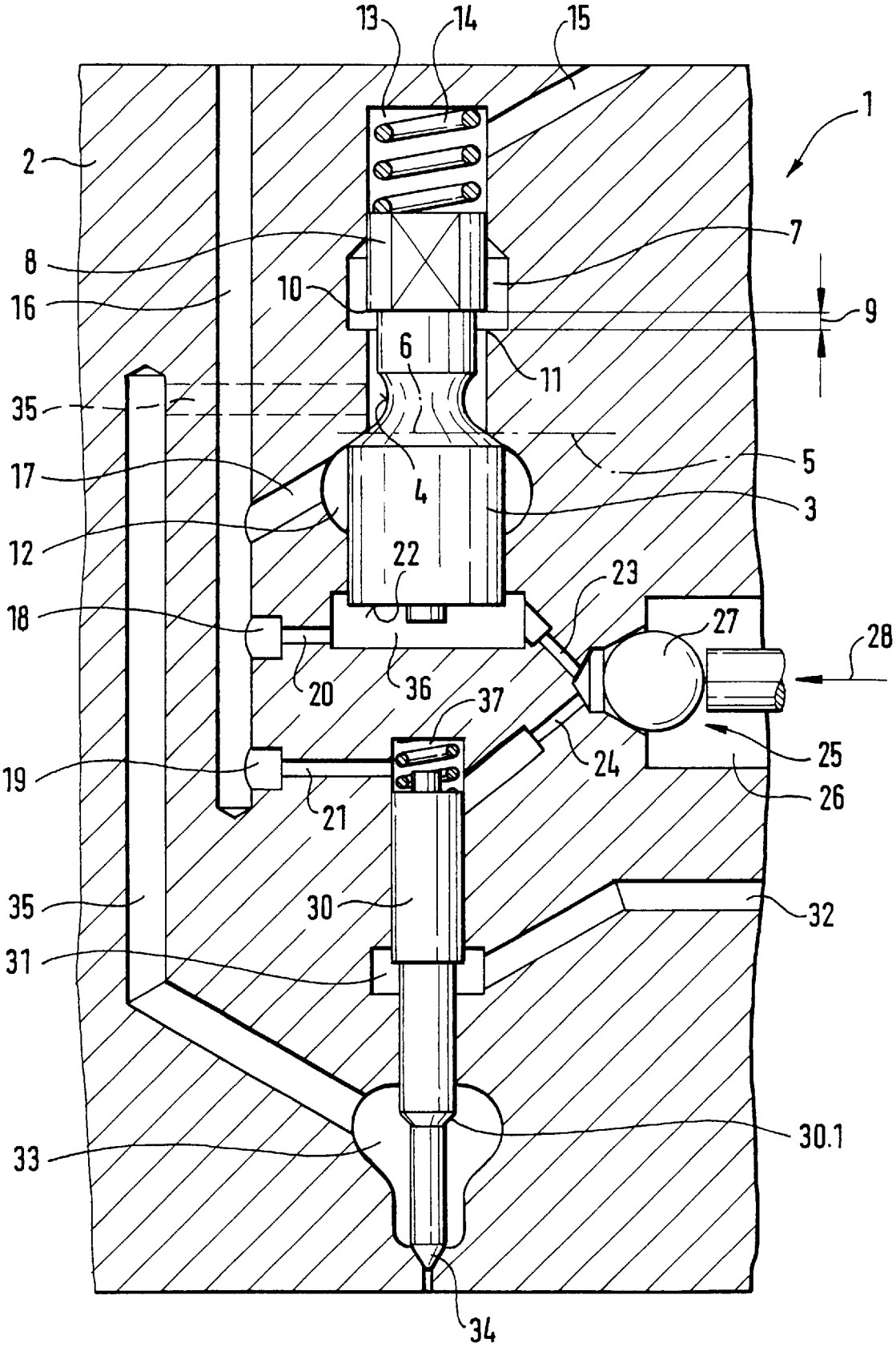
13
14
15
1
2
7
8
10
16
9
6
11
35
5
17
4
3
12
22
23
18
27
28
20
36
37
24
25
19
21
26
35
30
32
31
30.1
33
34

PRESSURE-CONTROLLED INJECTOR WITH CONTROLLED NOZZLE NEEDLE

BACKGROUND OF THE INVENTION

1. Field of the Invention

In injectors for injecting fuel into the combustion chambers of internal combustion engines, high pressures occur in applications in injection systems with a high-pressure collection chamber (common rail), and these pressures have to be controlled in terms of the mechanical stresses on the injector. Care must also be take to assure an immediate response of the injection nozzle system to opening and closing movements, if precise metering of the fuel quantities to be injection is not to be impaired and the shaping of the course of injection is not to be incorrectly altered.

2. Description of the Prior Art

German patent DE 37 28 817 C2 relates to a fuel injection pump for an internal combustion engine. The control valve member used in the fuel injection pump comprises a valve stem, which forces a guide sleeve and slides in a conduit, and a valve head connected to the valve stem and oriented in the actuation direction. The sealing face of the valve head cooperates with the area of the control bore that forms the valve seat. The valve stem has a recess on its circumference whose axial length extends from the orifice of the fuel supply line to the beginning of the sealing face on the valve head that cooperates with the valve seat, and a face exposed to the pressure of the fuel supply line is embodied in the recess. This face is equal in size to a face of the valve head exposed to the pressure of the fuel supply line when the control valve is in the closed state. As a result, the valve is pressure-balanced in the closed state; in addition, a spring element that urges the control valve to its opening position is disposed in the guide sleeve of the control valve.

In known versions of injectors for injecting fuel that is at extremely high pressure into the combustion chambers of a direct-injection internal combustion engine, the high pressure prevailing in the high-pressure collection chamber (common rail) prevails permanently at the control valve. In such injectors, the poor closure of the nozzle at its seat face is disadvantageous. Poor closure of the nozzle at its seat face is due to the fact that the pressure has to be reduced over the distance between the control part and the nozzle seat in order to effect the closure of the nozzle needle. The longer the closing phase lasts, the greater can the incident leakage losses become, which has an extremely adverse effect on the efficiency of injectors.

OBJECT AND SUMMARY OF THE INVENTION

With the version proposed by the invention, an injector for injecting fuel that is at high pressure can be designed such that a very high pressure prevails in the nozzle chamber of the injection nozzle when the nozzle needle opens. Furthermore, with the version proposed by the invention, fast needle closure can be assured.

The two control chambers embodied in the injector housing are acted upon, via suitable throttle elements, by the central fuel pressure prevailing from the high-pressure collection chamber. As a result, the high pressure prevailing in the high-pressure collection chamber also prevails at the branches, on the high-pressure inlet side, to the control chambers formed in the injector housing. These chambers are pressure-relieved simultaneously upon actuation of a control valve, and thus forced control of the opening motion of the nozzle needle is attainable by means of its vertical stroke in the injector housing. Embodying two control chambers in the injector housing makes it possible to adjust the nozzle system and the control part system independently of one another. By placing two inlet throttle elements upstream of the control chambers, both control chambers can be designed for optimal conditions for each. By direct action on a pressure shoulder face embodied in the nozzle chamber of the nozzle needle, the nozzle needle opens at its seat as soon as the nozzle chamber pressure exceeds the control chamber pressure. By simultaneous pressure relief of both control chambers provided in the injector housing, fast opening of the nozzle needle at its seat face can and hence a fast response of the injection nozzle can both be attained. A delay in the calculated injection onset and an attendant incorrect alteration of the injection pressure course from an overly slow pressure buildup in this inlet between the injection nozzle tip and the control part can thus be effectively counteracted.

BRIEF DESCRIPTION OF THE DRAWING

The invention will be better understood and further objects and advantages thereof will become more apparent from the ensuing detailed description taken in conjunction with the single drawing FIGURE which is sectional view of an injector for injecting fuel which is at high pressure into combustion chambers of internal combustion engines, with independent control chambers disposed with the injector in housings; the control chambers can be pressure-relieved jointly via a control element, and as a result forced control of the nozzle needle is attainable.

DESCRIPTION OF THE PREFERRED EMBODIMENTS

FIG. 1 schematically shows an injector 1, in which a vertically movable control part is movable in the injector housing 2. The control part is provided with a constriction 4 above a diameter region that extends from one face end 22 toward the control chamber. Between the cylindrical region of the control part 3 embodied with the larger diameter and the constriction 4, a valve seat 5 is formed. In the closed state, the control part 3 rests with its seat diameter 6 in the valve seat 5 in the injector housing 2, and by contact of the seat diameter 6 with the valve seat 5 in the injector housing 2, it closes a valve chamber 12 in the direction of a leaking oil chamber 7.

A leaking oil slide 8 embodied on the control part 3 adjoins the constriction 4 of the control part 3. The leaking oil slide 8 is surrounded laterally in the injector housing 2 by a leaking oil chamber 7. At the leaking oil slide 8, which upon pressure relief of the first control chamber 36 executes a vertically downward-oriented motion together with the control part 3, overlapping of the control edges 10 and 11 brings about sealing off of the leaking oil chamber 9 by intersection of the control edges when the valve chamber 12 is opened. Above the leaking oil slide 8, a hollow chamber 13 is provided, in which a compression spring 14 is received that acts upon the outlet-side end face of the leaking oil slide 8. A leaking oil line 15 branches off from the hollow chamber 13 in the injector housing 2 and continuously returns the leaking oil, present in the hollow chamber 13, to the fuel tank of a motor vehicle. Face elements which enable leaking oil to be drained off at the sides of the leaking oil slide 8 to the hollow chamber 13 are embodied on the leaking oil slide 8. The control edge 10 is embodied on the side of the leaking oil slide 8 toward the constriction 4, while the control edge 11 toward the housing is embodied on the injector housing 2.

From the high-pressure collection chamber (common rail), an inlet 16 extends in the injector housing 2 of the injector 1 and acts parallel, via a branch 17, on the valve chamber 12. The maximum pressure prevailing in the high-pressure collection chamber is present at this valve chamber. Also, beginning at the inlet 16 from the high-pressure collection chamber, a first branch 18 for a first control chamber 36 toward the control part and a second branch 19 for a control chamber 37 toward the nozzle needle are provided.

A first inlet throttle element 20 is received in the first branch 18 from the inlet 16 from the high-pressure collection chamber, and by way of this inlet throttle element, a control volume flows continuously into the first control chamber 36. In the second branch 19, which serves to act on the second control chamber 37 toward the nozzle needle, a second throttle element 21 is built in, by way of which the fuel at high pressure that is present from the high-pressure collection chamber (common rail) acts on the control chamber 37 toward the nozzle needle. Each of the two control chambers 36 and 37 has a respective individually configured outlet throttle element 23 and 24 on the outlet side. The outlet throttle elements 23, 24 discharge into a hollow chamber 26, provided on the outflow side, whose seat face can be closed and opened via a spherically embodied control valve element or ball 27. The spherically embodied closing element 27 is acted upon in the effective actuator direction 28 via an actuator, not shown in detail here, in the form of a piezoelectric actuator, an electromagnet, or a hydraulic-mechanical booster.

The actuator is externally actuated, independently of whatever pressure level prevails at the injector 1. Upon pressure relief of the spherically embodied closing element 27, a control volume flows out via the outlet throttle elements 23, 24 assigned to the control chambers 36 and 37, respectively, to the hollow chamber 26 on the outlet side, and as a result the control chambers 36 and 37 are pressure-relieved, and a projection motion of the control part 3 with its end face 22 into the control chamber occurs, while on the other side a projection motion of the nozzle needle 30 in the vertically upward-oriented direction also occurs.

The second control chamber 37 provided on the side toward the nozzle needle contains a spring element, which is braced on one end on the injector housing 2 and on the other on the control face of the nozzle needle 30. In a further extension of the nozzle needle 30, this needle is surrounded by an annularly configured leaking oil chamber 31, branching off from which is a leaking oil outlet 32, which can also be embodied as discharging into the fuel reservoir of the motor vehicle. In the further vertical extension of the nozzle needle 30, this needle is surrounded, in the region of the injection nozzle 34, by a nozzle chamber 33, which can be subjected to fuel at high pressure via a nozzle inlet 35.

In the nozzle chamber 33, an annular pressure shoulder face 30.1 is formed on the nozzle needle 30. The nozzle chamber 33 discharged into a nozzle seat in which the nozzle tip 34 of the nozzle needle 30 protrudes. The nozzle inlet 35, which toward the nozzle discharges into the nozzle chamber 33, is disposed on the side toward the control part in such a way that it is located above the valve seat 5, in the region of the constriction 4 of the control part 3. Upon pressure relief of the control chambers 36 and 37 when the actuator, which acts on the ball element 27, is triggered counter to its effective direction, the controller 36 of the control part and the controller 37 of the nozzle needle are pressure-relieved. A control volume flows out of the control chambers 36, 37 into the hollow chamber 26, via the outlet throttle elements 23 and 27 provided on the outlet side. As a result, the control part 3 with its end face 22 moves vertically downward and uncovers the closed valve seat. This causes fuel at high pressure, flowing in continuously via the branch 17, to flow out of the valve chamber 12 into the region between the constriction 4 and the injector wall of the injector housing 2 and enter the nozzle chamber 33 via the nozzle inlet 35. At the same time, upon a vertically downward-oriented projection motion of the control part 3 into the control chamber 36, an overlap of the control edges 10 of the leaking oil slide 8 and the control edge 11 on the housing is achieved, so that upon opening of the valve seat 5, an overflow of fuel, which is at high pressure, from the valve chamber 12 into the hollow chamber 7 on the leaking oil side can be averted. Thus the nozzle chamber 33 is acted upon by fuel that is at high pressure. At the same time, the control chamber 37 of the nozzle needle is pressure-relieved via the throttle 24 on the outlet side, and thus the upper end face of the nozzle needle 30 moves into the pressure-relieved control chamber 37, counter to the spring action of the spring element present there. The opening motion of the nozzle needle counter to the vertically upward-oriented direction is reinforced by high pressure that occurs in the nozzle chamber 33 at the pressure shoulder 30.1, so that when the high pressure prevailing in the control chamber 37 is exceeded, fast opening and thus an injection of the existing fuel quantity into the combustion chambers of and internal combustion engine can take place. This makes a forced opening of the nozzle needle 3 and thus of the nozzle tip 34 possible, with pressure relief of both control chambers 36 and 37, upon actuation of the actuator 28.

Upon closure, that is, when the open ball element 27 is acted upon in the effective actuator direction 28, the mode of operation of the injector proposed in the invention is as follows: By closure and by pressing of the ball element 27 into its seat face 25, the high pressure in the control chambers 36 and 37 builds up very rapidly, via the throttle elements 20 and 21 provided in the branches 18 and 19, respectively, from the inlet 16 from the high-pressure collection chamber. The control part 3 therefore moves into its closing position and closes the valve chamber 12; at the same time, the nozzle chamber 33 is pressure-relieved by opening of the control edge 10 and 11 on the injector housing 2 and the leaking oil slide 8, respectively, so that from the inlet 35 to the nozzle chamber 33, fuel that is at high pressure can flow out toward the leaking oil side into the hollow chamber 13. The nozzle chamber 33 is pressure-relieved as a result.

At the same time, in the control chamber 37 of the nozzle needle, high pressure builds up via the branch 19 in the inlet 16 from the high-pressure collection chamber, and this pressure, reinforced by the spring element received in the control chamber 37 of the nozzle needle, presses the nozzle needle into its seat at the injection nozzle 34. The end face, toward the control chamber, of the nozzle needle 30 is subjected to pressure prevailing from the high-pressure collection chamber, and as a result the pressure level in the control chamber 37 is considerably higher than that prevailing at the same time in the nozzle chamber 33. Because of the surface area ratios, the nozzle needle 30 is pressed into its closing position by the high pressure prevailing in the control chamber 37 from the high-pressure collection chamber, reinforced by the closing spring counter to the pressure force acting on the pressure shoulder 30.1 in the control chamber 33. As a result, faster closing of an open injection nozzle tip 34 can be achieved in comparison to the known injector embodiment, so that afterinjections into the combustion chambers of an internal combustion engine are suppressed, and a substantially more-exact course of the calculated injection event can be affected. The instants of opening and closing can moreover be adhered to substantially more exactly, which is beneficial in terms of emissions of an engine equipped with the injector proposed by the invention. By the embodiment of two control chambers 36 and 37 in the injector housing 2 of an injector that can be configured independently of one another, the control chambers can be adapted individually to one another by the appropriate choice of the surface areas 30.1 or the area of the end face of the nozzle needle 30 and by appropriate configurations of the inlet-side throttle elements 20 and 21 and the outlet-side throttle elements 23 and 24.

The foregoing relates to preferred exemplary embodiments of the invention, it being understood that other variants and embodiments thereof are possible within the spirit and scope of the invention.

I claim:

1. An injector for injecting fuel, which is at high pressure, into combustion chambers of an internal combustion engine, comprising a control part (3) and a nozzle needle (30) received movably in an injector housing (2), and an injection nozzle inlet (34) opened by opening of a valve chamber (12) by pressure relief of a control chamber (36), wherein in the injector housing (2), control chambers (36, 37) are adapted to actuate a nozzle needle (30) and the control part (3) which can be pressure-relieved via a common control valve (25, 27), with each of the control chambers (36, 37) including a separate throttle element (23, 24) located on the outlet-side.

2. The injector according to claim 1, wherein the control chambers (36, 37) can each be acted upon by controlling the volume via respective inlet-side throttle elements (20, 21) integrated into an inlet (16) from a high-pressure collection chamber.

3. The injector according to claim 2, wherein, via the design of the inlet-side throttle elements (20, 21) and outlet-side throttle elements (23, 24), respectively, the control chambers (36, 37) can be adapted independently of one another.

4. The injector according to claim 1, wherein the control chambers (36, 37) for the nozzle needle (30) and for the control part (3) are independent of one another.

5. The injector according to claim 1, wherein, via the design of the inlet-side and outlet-side throttle elements (20, 21) and (23, 24), respectively, the control chambers (36, 37) can be adapted independently of one another.

6. The injector according to claim 1, wherein nozzle chamber (33) is adapted to receive high pressure fuel and serves as a fuel reservoir on the end face of the nozzle needle (30) adjacent control chamber (37) on the side toward the nozzle needle.

7. The injector according to claim 6, wherein the area of the face end of the nozzle needle (30) is larger than the annular area of a pressure shoulder (30.1) in the region of the nozzle chamber (33) surrounding the nozzle needle (30).

8. The injector according to claim 1, wherein the control chambers (36, 37) for the nozzle needle (30), for the control part (3) and a valve chamber (12) are contained within injector housing (2).

* * * * *